US011052400B2

(12) United States Patent
Dallimore et al.

(10) Patent No.: US 11,052,400 B2
(45) Date of Patent: Jul. 6, 2021

(54) LOCKING DEVICE FOR LOCKING A HAMMER TO A ROTOR IN A HORIZONTAL SHAFT IMPACT CRUSHER

(71) Applicant: SANDVIK INTELLECTUAL PROPERTY AB, Sandviken (SE)

(72) Inventors: Rowan Dallimore, Somerset (GB); Andreas Forsberg, Malmo (SE); Knut Kjaerran, Svedala (SE)

(73) Assignee: SANDVIK INTELLECTUAL PROPERTY AB, Sandviken (SE)

( * ) Notice: Subject to any disclaimer, the term of this patent is extended or adjusted under 35 U.S.C. 154(b) by 104 days.

(21) Appl. No.: 16/312,046

(22) PCT Filed: Jul. 1, 2016

(86) PCT No.: PCT/EP2016/065516
§ 371 (c)(1),
(2) Date: Dec. 20, 2018

(87) PCT Pub. No.: WO2018/001513
PCT Pub. Date: Jan. 4, 2018

(65) Prior Publication Data

US 2019/0381510 A1 Dec. 19, 2019

(51) Int. Cl.
*B02C 13/00* (2006.01)
*B02C 13/28* (2006.01)

(52) U.S. Cl.
CPC .. *B02C 13/2804* (2013.01); *B02C 2013/2808* (2013.01); *B02C 2210/02* (2013.01)

(58) Field of Classification Search
CPC ..... B02C 13/2804; B02C 2013/2808
See application file for complete search history.

(56) References Cited

U.S. PATENT DOCUMENTS 2,747,803 A 5/1956 Benard
2,751,006 A * 6/1956 Lane ..... B23D 35/002 83/674
3,574,251 A * 4/1971 Corti ..... B23C 5/2437 407/45
4,009,742 A * 3/1977 Ziegelmeyer ..... B27G 13/04 144/230

(Continued)

FOREIGN PATENT DOCUMENTS

CN 2354662 Y 12/1999
CN 104619419 A 5/2015

(Continued)

*Primary Examiner* — Faye Francis
(74) *Attorney, Agent, or Firm* — Corinne R. Gorski

(57) ABSTRACT

A locking device for a crusher rotor of a horizontal shaft impact crusher includes a locking-wedge having a first through bore, a screw element for driving the locking-wedge into a locking position between a rotor arm and the hammer element and for holding the locking-wedge in the locking position, thereby fixing the hammer element to the rotor disc, a locking nut for receiving the locking screw element, and a locking nut holder. The screw element is at least partly located in the first through bore and extends through the locking nut. The locking nut holder holds the locking nut in a manner that prevents the locking nut from rotating as the screw element is driven through the locking nut.

15 Claims, 9 Drawing Sheets

(56) References Cited

U.S. PATENT DOCUMENTS

| | | | | |
|---|---|---|---|---|
| 5,240,192 | A * | 8/1993 | Tilby | A01F 29/095 144/174 |
| 5,529,249 | A | 6/1996 | Braun et al. | |
| 5,857,506 | A * | 1/1999 | Paolone | B23C 5/2265 144/174 |
| 6,089,480 | A * | 7/2000 | Rawlings | B02C 18/144 241/189.1 |
| 6,427,791 | B1 * | 8/2002 | Glowka | E21B 10/633 175/413 |
| 7,290,726 | B2 * | 11/2007 | Latham | E21C 35/1936 241/294 |
| 7,338,134 | B2 * | 3/2008 | Latham | E21C 25/10 299/87.1 |
| 7,448,567 | B2 * | 11/2008 | Roozeboom | B02C 13/06 241/191 |
| 9,623,420 | B2 * | 4/2017 | Dobrovosky | B02C 13/06 |
| 9,631,490 | B2 * | 4/2017 | Latham | E21C 35/1933 |
| 2001/0045478 | A1 * | 11/2001 | Recker | B02C 18/145 241/294 |
| 2003/0127550 | A1 | 7/2003 | Stemper | |
| 2015/0069160 | A1 | 3/2015 | Roozeboom et al. | |

FOREIGN PATENT DOCUMENTS

| | | | |
|---|---|---|---|
| EP | 2987556 | A1 | 2/2016 |
| GB | 597569 | A | 1/1948 |
| JP | H110299744 | A | 11/1998 |
| WO | 2010071550 | A2 | 6/2010 |
| WO | 2011129742 | A1 | 10/2011 |
| WO | 2011129744 | A1 | 10/2011 |
| WO | 20131410049 | A1 | 9/2013 |
| WO | 2013189687 | A1 | 12/2013 |
| WO | 2013189691 | A1 | 12/2013 |

* cited by examiner

LOCKING DEVICE FOR LOCKING A HAMMER TO A ROTOR IN A HORIZONTAL SHAFT IMPACT CRUSHER

RELATED APPLICATION DATA

This application is a § 371 National Stage Application of PCT International Application No. PCT/EP2016/065516 filed Jul. 1, 2016.

FIELD OF INVENTION

The present invention relates to a locking device for mounting and dismounting hammer parts on to a rotor of a horizontal shaft impact crusher (HSI-crusher). The invention also relates to a HSI-crusher including at least one of the locking devices.

BACKGROUND ART

Horizontal shaft impact crushers (HSI-crushers) are utilized in many applications for crushing hard material, such as pieces of rock, ore etc. A HSI-crusher comprises a crushing chamber housing a rotor (alternatively termed an impeller) that is driven to rotate about a horizontal axis. Pieces of rock are fed towards the rotor and are struck by rotor mounted hammer elements. The rock pieces are disintegrated initially by striking contact with the hammer elements and are then accelerated and thrown against breaker plates (typically referred to as curtains) to provide further disintegration. The action of the rotor causes the material fed to the horizontal shaft impact crusher to move freely in the chamber and to be crushed upon impact against the hammer elements, against the curtains, and against other pieces of material moving around at high speed within the chamber. Example HSI-crushers are described in WO 2010/071550; WO 2011/129744; WO 2011/129742; WO 2013/189691 and WO 2013/189687.

Due to the abrasive nature of the materials being crushed, the hammers wear and need to be replaced. Accordingly, the hammers are fitted to the rotor in a removable fashion.

It is known to mount a hammer on to a rotor of a HSI-crusher using wedge-shaped locking devices. Each locking device includes a wedge-shaped body, having a central hole through body, a locking nut, and a locking screw extending through body and the locking nut. In order to attach a hammer to the rotor using prior art locking devices two fitters are required. A first fitter uses a spanner to hold the locking nut and a second fitter uses a T-shaped turning tool to rotate the screw element. The first fitter prevents the locking nut from rotating as the screw element is driven therethrough. The locking screw drives the wedge-shaped body against the hammer element thereby fixing the hammer element to a rotor disc.

One problem with this approach is that it requires two fitters to apply. This is not a very efficient use of labour. A second problem with this approach is that the there is a significant health and safety risk for the fitter using the spanner since that fitter has to place his hands underneath the locking device and hammer. If the hammer should slip out of a lifting tool, it would crush the fitter's hand, since each hammer is very heavy, typically around 800 kg. Also, the hammer can move during a mounting process, which can trap a fitter's hands.

Another problem with the prior art mounting device is that crushed rock can enter the central hole housing the screw element. This can prevent the T-shaped turning tool from accessing screw element, which makes it very difficult to dismount the hammer from the rotor. This problem has been addressed to some extent by inserting a plastic cap into the central hole to block the ingress of rock, however it has been found that the plastic cap often becomes dislodged during use of the crusher, which allows rock into the hole.

SUMMARY OF THE INVENTION

The invention seeks to provide a locking device that facilitates mounting and dismounting of hammer elements on to a HSI-crusher that mitigates at least one of the above problems, or at least provides an alternative arrangement to known locking devices.

In particular, it is an objective of the invention to reduce and eliminate, as far as possible, the health and safety risks by which operating personnel are exposed during hammer mounting and dismounting procedures so as to avoid injuries to an operator's hands and fingers. It is a further objective of the invention to provide a locking device having a means for protecting a screw element from damage from rocks. It is a further objective of the invention to provide a locking device having more than one means of applying a load to the hammer device. It is a further objective of the invention to provide a locking device that is relatively quick and easy to install. It is a further objective of the invention to provide a locking device that can be installed by one person.

At least one of the objectives is achieved by a locking device that includes a locking-wedge and a nut holder, which prevents a locking nut from rotating when a locking screw element is driven through it.

At least one of the objectives is achieved by a locking device that includes a locking-wedge and an installation handle, in particular an installation handle that is removably attachable to the locking-wedge.

At least one of the objectives is achieved by a locking device that includes a locking-wedge having a first bore for a locking screw element, a second bore which bisects the first bore, and a protective member removably insertable into the second bore to protect the screw element.

According to a first aspect of the present invention there is provided a locking device for a crusher rotor of a horizontal shaft impact crusher, said rotor including at least one hammer element and at least one rotor disc having a plurality of rotor arms, the locking device comprising: a locking-wedge, including a first bore; a screw element for driving the locking-wedge into a locking position between a rotor arm and the hammer element, and for holding the locking-wedge in the locking position, thereby fixing the hammer element to the rotor disc; a locking nut for receiving the locking screw element; and a locking nut holder. The first bore is arranged to receive the screw element, the screw element is drivable through the locking nut, and the locking nut holder holds the locking nut in a manner that prevents the locking nut from rotating as the screw element is driven through the locking nut.

The invention obviates the need for a second fitter to hold the nut with a spanner. The invention improves health and safety aspects of mounting a hammer element on to a rotor since the fitter is not required to place his hands underneath the locking-wedge or at the base of the hammer element. Also, the nut holder protects the locking nut from being damaged in use, since it provides a protective housing for the locking nut. This helps to ensure that nut threads do not become clogged/damaged in use, which would otherwise be problematic for subsequent removal and installation.

In preferred embodiments the nut holder is releasably attachable to the locking-wedge by attachment means, such as a plurality of bolts. The locking-wedge can include a plurality of tapped holes for receiving the bolts. The nut holder includes a plurality of bores for receiving the bolts. The bores extend through the nut holder.

In preferred embodiments the nut holder is arranged for limited movement with respect to the locking-wedge. The arrangement is such that driving the screw element through the nut causes the nut holder to move towards the locking-wedge. Preferably the nut holder is loosely attached to the attachment means. For example, the nut holder can be loosely mounted to the mounting bolts, and is arranged to move with respect to the bolts.

The nut holder is positioned with respect to the locking-wedge, such that the nut is axially aligned with the first bore.

In preferred embodiments the locking device includes resilient means, such as at least one spring or compression washer, located between locking-wedge and the nut holder. The nut holder is arranged to clamp the resilient means between the nut holder and the locking-wedge as the screw element is driven through the nut. The resilient means helps to prevent the screw element from coming loose during operation of the crusher.

In preferred embodiments the nut holder includes a clamping member. The clamping member includes first and second side members and a cross-piece. The clamping member has a generally n-shaped body. The locking nut is housed in a gap between the first and second side members. The clamping member impinges on the nut, thereby preventing the nut from rotating when the screw element is driven through the nut. Preferably at least one of the first and second side members impinges on the nut.

Preferably the clamping member is oriented with respect to the locking-wedge such that the cross-piece is closest to a thick end of the locking-wedge. The first and second side members protrude substantially perpendicularly away from the thick end of the wedge. When the locking-wedge is located in its locking position on the rotor, the nut holder is located radially more inwardly than the locking-wedge. That is, the nut holder is located closer to a rotor hub than the locking-wedge.

In preferred embodiments the locking device includes a retaining member. The retaining member prevents the nut from falling out of the clamping member during use. Preferably the retaining member is releasably attachable to the clamping member.

In preferred embodiments the locking-wedge includes a thin end and a thick end, and the first bore extends through the locking-wedge from the thin end to the thick end.

In preferred embodiments the first bore has first and second ends. The first end opens at the thin end of the locking-wedge. The second end opens at the thick end of the locking-wedge. The locking nut is located adjacent the second end. The screw element includes a turning formation, which is accessible by a turning tool via the first end of the first bore.

That is, the screw element is driven from the thin end of the locking-wedge. When the locking-wedge is in its locking position on the rotor, the first through bore is arranged substantially radially with respect to the rotor hub.

In preferred embodiments the locking-wedge includes first and second engagement faces. When in the locking position, one of the first and second engagement faces engages the rotor arm and the other of the first and second engagement faces engages the hammer element. The first and second engagement faces are arranged opposite to one another. The first engagement face is inclined with respect to the second engagement face.

In preferred embodiments the locking-wedge has a substantially trapezoid cross-section, and preferably a right trapezoid cross-section. When the locking-wedge is in its locking position on the rotor, the thin end of the locking-wedge is located radially outermost, and the thick end of the wedge radially innermost.

In preferred embodiments the locking-wedge includes a recess formed at the thick end. The recess is arranged to house the resilient means. Preferably the recess is arranged to house at least part of the nut holder.

In preferred embodiments the locking-wedge includes a second bore. The second bore bisects the first bore.

In preferred embodiments the second bore is arranged transversely to first bore.

In preferred embodiments the second bore is located towards the thin end of the locking-wedge. The second bore extends through the locking-wedge from a first side of the locking-wedge to a second side of the locking-wedge. The first and second sides face generally axially, in opposite directions, when the locking-wedge is located in the locking position, and the second bore is arranged substantially parallel with a rotor axis. The first side face is arranged generally orthogonally to at least one of the first and second engagement faces. The second side face is arranged generally orthogonally to the first and second engagement faces. The first and second side faces are generally parallel to one another.

In preferred embodiments the locking device includes a protective member, such as a bolt, that is removably insertable into the second bore. The protective member protects the head of the screw element from rocks. Preferably the protective member is rigid and durable. Typically the protective member includes metal, such as steel. For embodiments using a bolt as the protective member, a nut can be provided to secure the bolt within the second bore. This has the advantage of ensuring that the bolt is not dislodged from the second bore, and is easy to remove after use.

In preferred embodiments the locking device includes an installation handle that is releasably attachable to the locking-wedge. The installation handle is arranged to lever the locking-wedge into an initial locking position.

According to another aspect of the invention there is provided a horizontal shaft impact crusher, including a crusher rotor having at least one hammer element; at least one rotor disc having a plurality of rotor arms; and at least one locking device, comprising: a locking-wedge in a locking position between a rotor arm and the hammer element, said locking-wedge fixing the hammer element to the rotor disc; a screw element for driving the locking-wedge into the locking position, and for holding the locking-wedge in the locking position; a locking nut for receiving the locking screw element; and a locking nut holder. The locking-wedge includes a first bore, the screw element is at least partly located in the first bore and extends through the locking nut, and the locking nut holder holds the locking nut in a manner that prevents the locking nut from rotating as the screw element is driven through the locking nut.

The or each locking device can be arranged according to any configuration described herein.

In preferred embodiments the rotor includes a second rotor disc having a plurality of rotor arms and a second locking device for locking the hammer element to the second rotor disc. The rotor can include at least one additional rotor disc having a plurality of rotor arms and at least one additional locking device for locking the hammer element to the additional rotor disc. Each rotor disc is axially spaced apart. Typically each rotor disc includes two to six, and preferably four rotor arms. Typically each rotor includes two to six hammer elements, and preferably four or five hammer elements. Each hammer element is fixed to the rotor discs in the manner described herein.

According to another aspect of the invention there is provided a locking device for a crusher rotor of a horizontal shaft impact crusher, said rotor including at least one hammer element and at least one rotor disc having a plurality of rotor arms, the locking device comprising: a locking-wedge, including a first through bore and a second through bore, which bisects the first through bore; a screw element for driving the locking-wedge into a locking position between a rotor arm and the hammer element, and for holding the locking-wedge in the locking position, thereby fixing the hammer element to the rotor disc; a locking nut for receiving the locking screw element, wherein the screw element is at least partly located in the first through bore and extends through the locking nut; and a protective member, such as a bolt, removably insertable into the second through bore to protect the screw element.

According to another aspect of the invention there is provided a horizontal shaft impact crusher, including a crusher rotor having: at least one hammer element; at least one rotor disc having a plurality of rotor arms; and at least one locking device, comprising: a locking-wedge, including a first through bore and a second through bore, which bisects the first through bore; a screw element for driving the locking-wedge into a locking position between a rotor arm and the hammer element, and for holding the locking-wedge in the locking position, thereby fixing the hammer element to the rotor disc; a locking nut for receiving the locking screw element, wherein the screw element is at least partly located in the first through bore and extends through the locking nut; and a protective member, such as a bolt, removably insertable into the second through bore to protect the screw element.

BRIEF DESCRIPTION OF DRAWINGS

A specific implementation of the present invention will now be described, by way of example only, with reference to the accompanying drawings, in which.

DETAILED DESCRIPTION OF PREFERRED EMBODIMENT OF THE INVENTION

Figure 1:
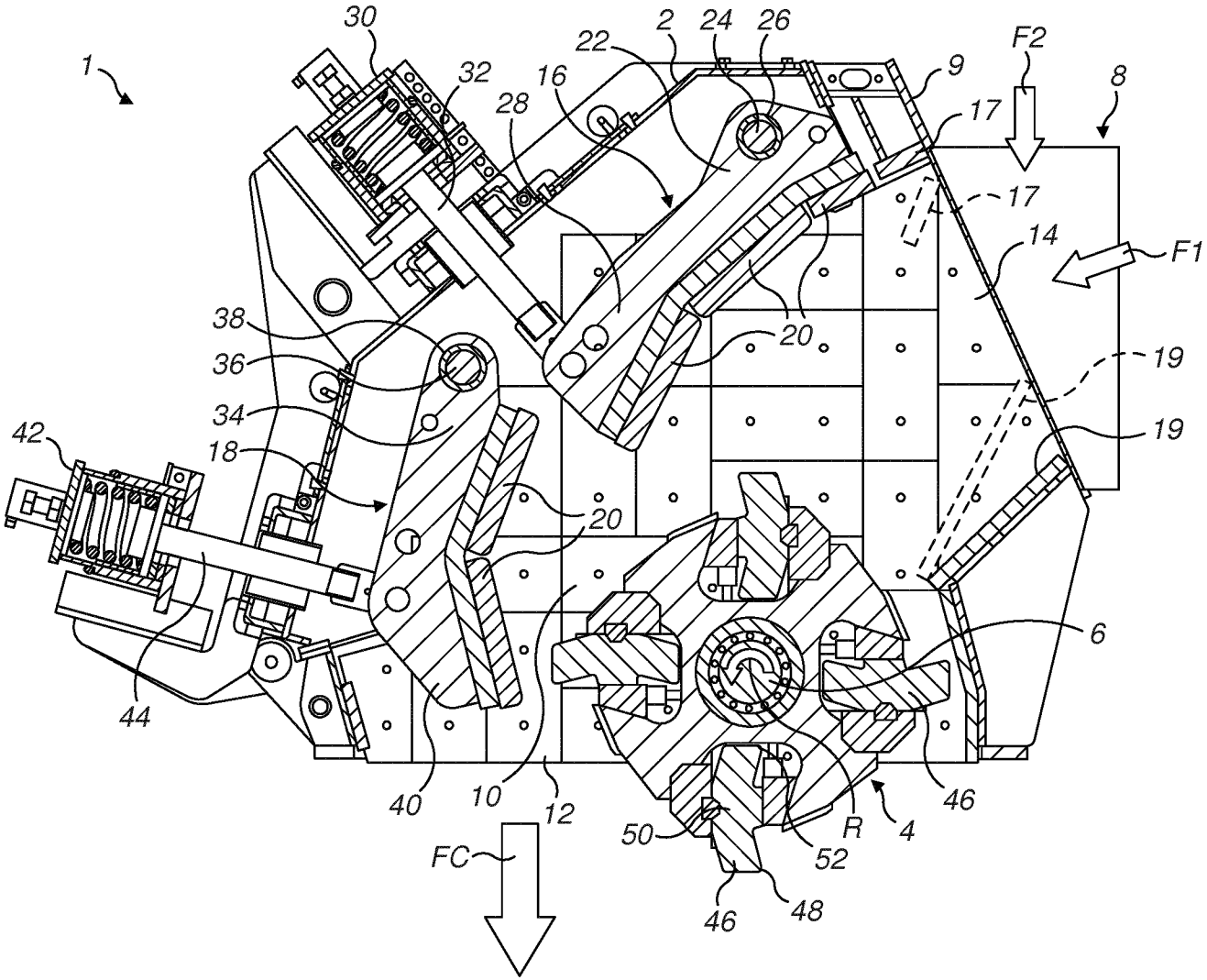
FIG. 1 is cross-sectional side view of a horizontal shaft impact crusher in accordance with the invention comprising a rotor having a plurality of replaceable hammer elements releasably mounted to rotor discs, each hammer element being locked to the rotor disc by a plurality of locking devices.

Referring to FIG. 1 a horizontal shaft impact crusher 1 (HSI-crusher) comprises a housing 2 in which a rotor indicated generally by reference 4 is rotatably mounted. A motor, (not illustrated) is operative for rotating a horizontal shaft 6 on which the rotor 4 is mounted. As an alternative to rotor 4 being fixed to shaft 6, rotor 4 may rotate around shaft 6. In either case, rotor 4 is operative for rotating around a horizontal axis, coaxial with the centre of shaft 6.

Material to be crushed is fed to a feed chute 8, which is mounted to an inlet flange 9 of housing 2, and enters a crushing chamber 10 positioned inside the housing 2 and at least partly enclosing the rotor 4. Material crushed within the crusher 1 exits the crushing chamber 10 via a crushed material outlet 12. Housing 2 is provided with a plurality of interior wear protection plates 14 operative for protecting the interior of crushing chamber 10 from abrasion and impact by the material to be crushed.

Crusher 1 comprises a first curtain 16, and a second curtain 18 arranged inside crushing chamber 10. Each curtain 16, 18 comprises at least one wear plate 20 against which material may be crushed. A first end 22 of first curtain 16 is mounted via a horizontal first pivot shaft 24 extending through an opening 26 formed in curtain 16 at the first end 22. First pivot shaft 24 extends further through openings in the housing 2 to suspend the first end 22 in the housing 2. A second end 28 of first curtain 16 is connected to a first adjustment device 30 comprising at least one adjustment bar 32. A first end 34 of second curtain 18 is mounted by means of a horizontal second pivot shaft 36 extending through an opening 38 formed in curtain 18 at first end 34. Second pivot shaft 36 extends further through openings in the housing 2 to suspend the first end 34 in the housing 2. A second end 40 of second curtain 18 is similarly connected to a second adjustment device 42 comprising at least one adjustment bar 44.

In operation, the HSI-crusher 1 can be adjusted to a first crushing setting, which for example may be a primary crushing setting, for crushing large objects (typically having a maximum particle size of 300-1200 mm), and a second (or secondary) crushing setting being different from the first setting for crushing intermediate size objects (having a maximum particle size of less than 400 mm and typically 20-400 mm). When crusher 1 is operated in the primary setting the crushed material exiting crusher 1 via the outlet 12 would typically have an average particle size of 35-300 mm, and typically at least 75% by weight of the crushed material would have a particle size of 20 mm or larger. When crusher 1 is operated in the secondary setting the crushed material leaving the crusher 1 via the outlet 12 would typically have an average particle size of 5 to 100 mm, and typically at least 75% by weight of the crushed material would have a particle size of 5 mm or larger. Within the present specification the 'average particle size' refers to weight based average particle size.

Adjusting crusher 1 to the primary crushing setting would typically involve retracting the first and/or second curtains 16, 18 away from rotor 4, to form a crushing chamber 10 having a large volume and a large distance between the rotor 4 and the wear plates 20 of curtains 16, 18. Such retraction of at least one curtain 16, 18 would be performed by operating the first and/or second adjustment devices 30, 42, which may typically involve hydraulic cylinders and/or mechanical adjustment devices using threaded bars. Adjusting the crusher 1 to the secondary crushing setting would, on the other hand, typically involve moving the first and/or second curtains 16, 18 towards the rotor 4 by means of operating the first and/or second adjustment devices 30, 42, to create a crushing chamber 10 having a small volume and a short distance between the rotor 4 and the wear curtain plates 20. In addition to adjusting the position of the curtains 16, 18, the horizontal shaft impact crusher feed chute 8 is adjusted to feed the material into the crushing chamber 10 in a first direction F1 when crusher 1 is adjusted to the primary setting, and in a second direction F2 when crusher 1 is adjusted to the secondary setting. Hence, the first crushing setting is different from the second crushing setting. Furthermore, the first direction F1 of feeding material to the crusher 1 is different from the second direction F2 of feeding material to the crusher 1.

The adjustment of the HSI-crusher 1 from a primary crushing setting to a secondary crushing setting may also involve adjusting the positions of an upper feed plate 17 and a lower feed plate 19 that are located just inside of the inlet flange 9 of the housing 2 of the crusher 1. The feed plates 17, 19 protect the inlet of the housing 2, and provide the material fed to housing 2 with a desired direction. In FIG. 1, the upper and lower feed plates 17, 19 are adjusted to the primary setting (shown in unbroken lines) with the intention of directing the coarse material towards rotor 4 and the first curtain 16 when the crusher 1 operates in the primary setting. The positions of the upper and lower feed plates 17, 19 in the secondary setting are indicated with broken lines in FIG. 1. As can be seen the upper and lower feed plates 17, 19 are, in the secondary setting, arranged for directing the material directly towards the rotor 4. In this manner, the rather fine material fed when the crusher 1 operates in the secondary setting will receive more 'hits' from the rotor hammer elements 46 leading to a greater reduction in the size of the material.

In operation material to be crushed is fed to the feed chute 8 and further into the crushing chamber 10, either in the direction F1 if the crusher 1 is adjusted to the primary setting or in the direction F2 if crusher 1 is adjusted to the secondary setting. The material will first reach that part of the crushing chamber 10 which is located adjacent to first curtain 16, being located upstream of the second curtain 18 as seen with respect to the direction of travel of the material. Rotor 4 is rotated at typically 400-850 rpm. When the material is impacted by the rotor elements 46 it will be crushed and accelerated against wear plates 20 of first curtain 16 where subsequent and further crushing occurs. The material will bounce back from first curtain 16 and will be crushed further against material travelling in the opposite direction and then again against the elements 46. When the material has been crushed to a sufficiently small size it will move further down the crushing chamber 10, and will be accelerated, by means of the elements 46, towards wear plates 20 of the second curtain 18, being located downstream of first curtain 16. When the material has been crushed to a sufficiently small size it exits chamber 10 via outlet 12 as a flow of crushed material FC.

The rotor 4 includes four hammer elements 46 according to the specific embodiment, with each element 46 having a generally curved or 'banana'-like shape profile, when view in cross-section. An arrow R in Figure indicates the rotational direction of rotor 4. A leading edge 48 of each respective hammer element 46 extends in the direction of rotation R. Prior to extended use, hammer element 46 is symmetric around a central portion 50. However, once leading edge 48 has been worn element 46 can be turned and mounted with its second leading edge 52 operative for crushing material.

Figure 2:
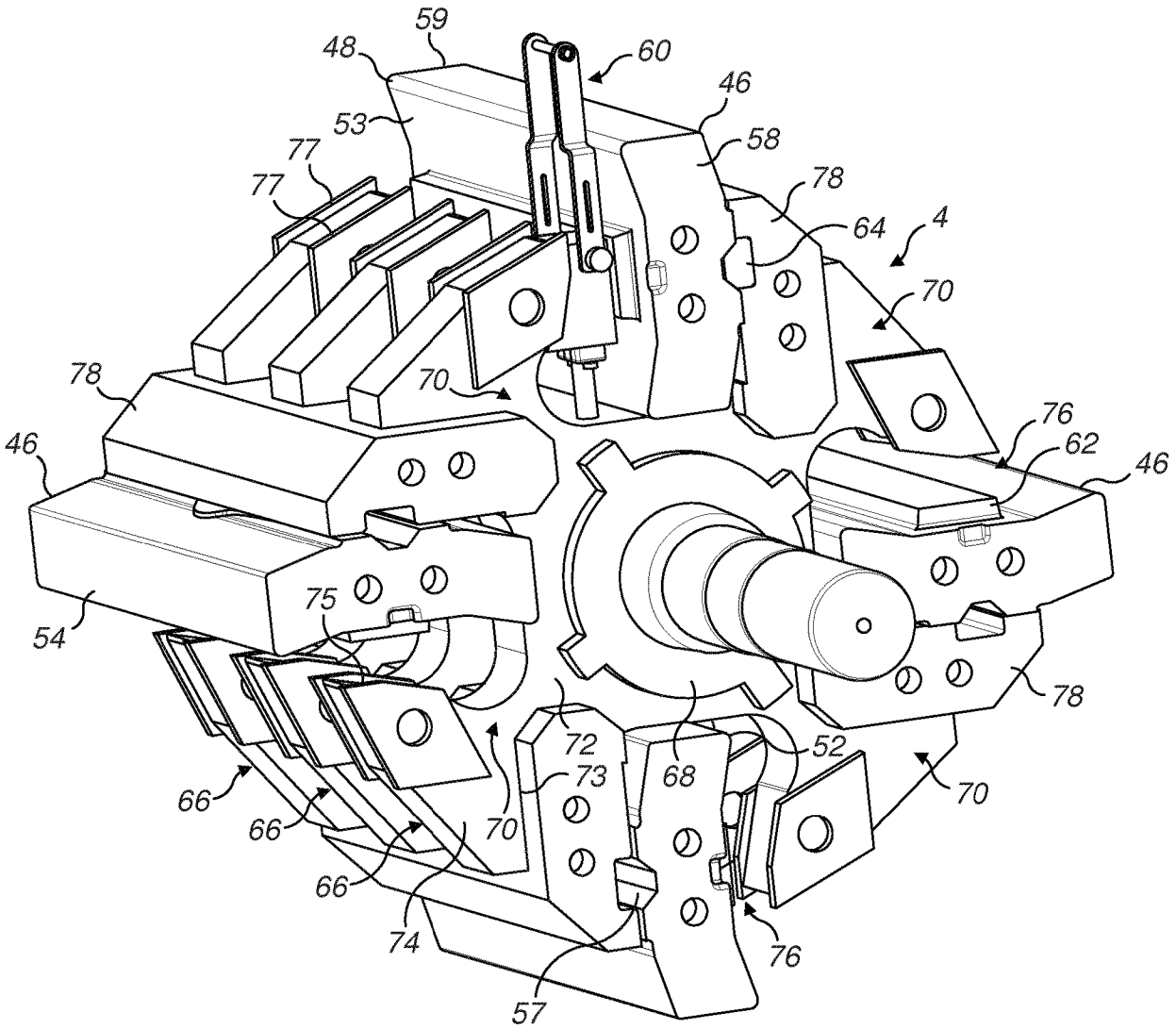
FIG. 2 is an isometric view of the rotor of FIG. 1, having a locking device with an installation handle mounted thereon.

The rotor 4 includes three rotor discs 66 (see FIG. 2), which are distributed along a rotor hub 68. The rotor discs 66 are axially spaced apart. Each rotor disc 66 includes four rotor arms 70, which extend radially outwards from the hub 68. The three rotor discs 66 are rotationally aligned such that the rotor arms 70 are aligned when viewed from an end of the rotor 4. Each arm 70 has a leading face 73, which faces generally in the direction of rotation of the rotor, and a trailing face 75, which faces in a direction generally opposite to the direction of rotation of the rotor. Each arm 70 includes a root portion 72, which protrudes radially outwards from the hub 68, and a head portion 74 connected to the root portion 72. Two plates 77 are mounted on to each head portion 74, one on each side of the head portion 74. The plates 77 project beyond the head portion 74, in a circumferential direction, and locate their respective locking devices 60. In particular, the plates 77 prevent the locking devices 60 from moving axially along the rotor 4 during operation of the crusher.

A slot 76 is located between each adjacent pair of rotor arms 70.

The rotor 4 includes four elongate mounting members 78, each of which is arranged to support one of the hammer elements 46. Each mounting member 78 is located in one of the slots 76 and is mounted on to the three rotor discs 66. Each mounting member is attached the leading faces 73 of its respective rotor arms 70.

Each hammer element 46 is mounted on to one of the mounting members 78. Each hammer element 46 comprises a generally rectangular main body having a main length defined by and extending between a first end 58 and a second end 59. The pair of material contact edges 48 and 52 extend lengthwise between the first and second ends 58,59. Each hammer element 46 includes a front face 53 configured for positioning with the rotational direction of rotor 4 so as to represent a leading face. Element 46 further comprises a rear face 54 positioned opposed to the rotational direction of rotor 4 so as to represent a trailing face of element 46. To optimise the crushing performance of element 46, front face 53 is generally concave whilst rear face 54 is generally convex. Accordingly, leading edge 48 represents a forward most part of face 53 when element 46 is mounted at rotor 4 via locking devices 60.

At least one generally rectangular mounting projection 62 is positioned at a mid-width position of front face 53. The mounting projection 62 extends along substantially the full length of the hammer element 46. The projection is arranged to engage the locking devices 60.

Rear face 54 also comprises two slots 57, which are arranged to receive mounting elements 64. The mounting elements 64 are provided to locate the hammer element 46 on to the rotor 4, and to prevent the hammer element 46 from moving axially along the rotor, in use.

Figure 3:
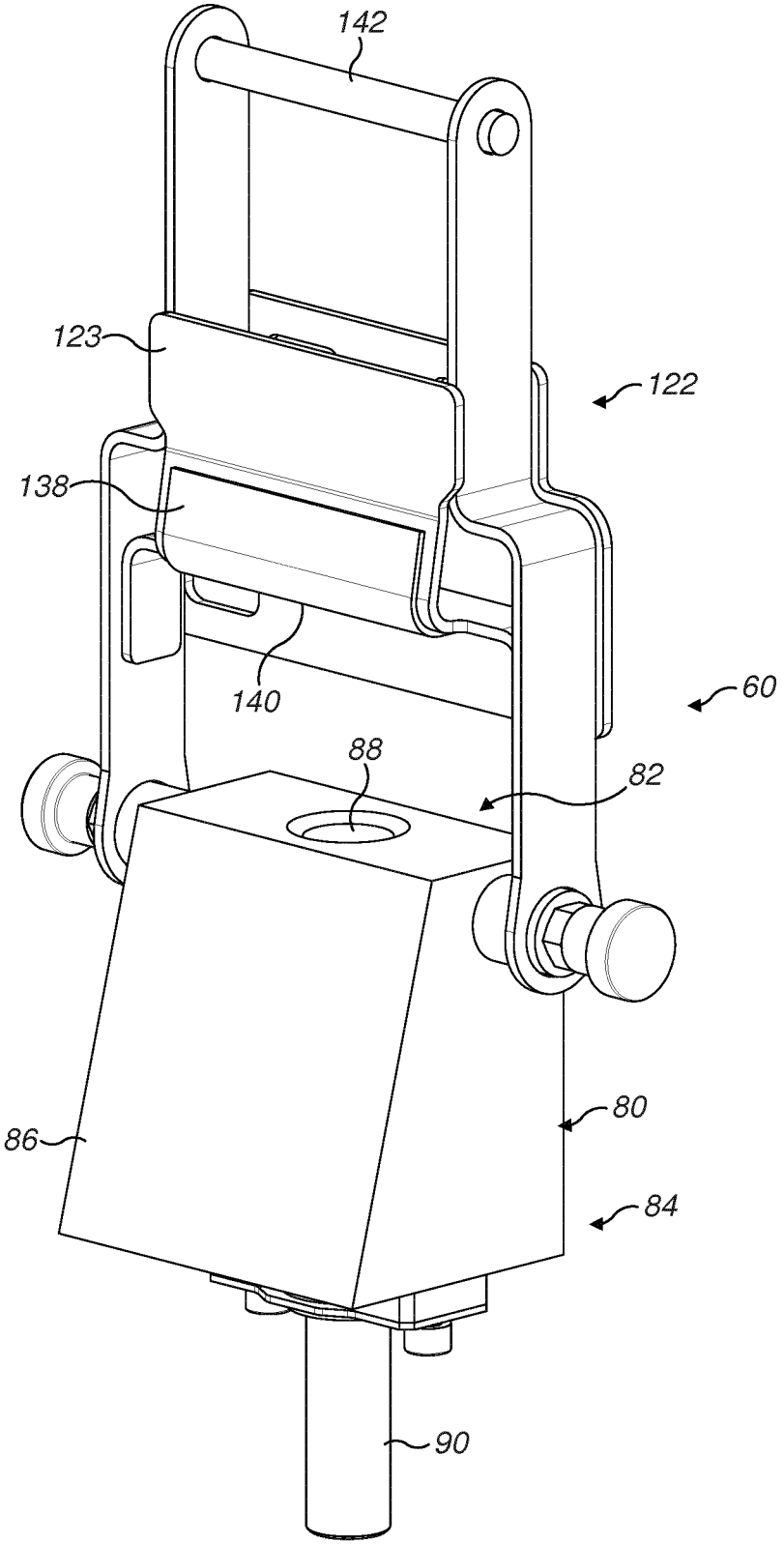
FIG. 3 is an isometric view of the locking device from FIG. 2.
Figure 4:
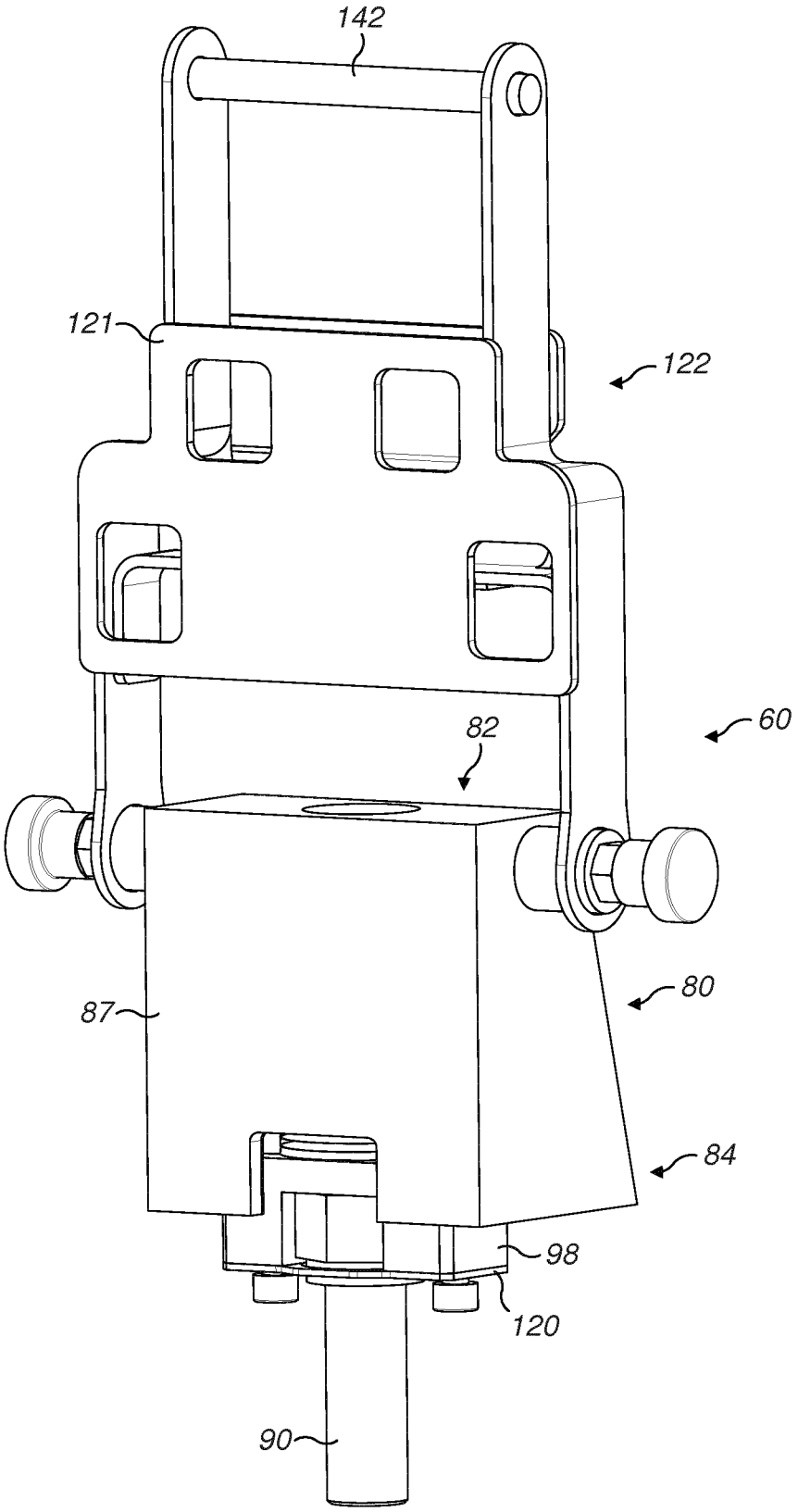
FIG. 4 is an isometric view of the locking device shown of FIG. 2.

Each locking device 60 includes, a wedge-shaped body 80 (FIG. 3). The wedge-shaped body 80 has a thin end 82 and a thick end 84. The wedge-shaped body 80 has a substantially trapezoid cross-section, and preferably a right trapezoid cross-section. The body has a first engagement surface 86 that tapers from the thin end 82 to the thick end 84. The first engagement surface 86 is arranged to engage the trailing face 75 of one of the rotor arms 70. The body has a second engagement surface 87 (FIG. 4) that is arranged to engage the hammer element 46, in particular to engage the mounting projection 62. The wedge-shaped body 80 is sized for jamming between a first rotor arm 70 and the hammer element 46, thereby locking the hammer element 46 to one of the mounting members 78, and hence locking the hammer element 46 for rotation with the rotor 4.

The wedge-shaped body 80 includes a central bore 88. The central bore 88 extends through the body from the thin end 82 to the thick end 84. The bore 88 is arranged to receive a screw element 90, which is used to drive the wedge-shaped body 80 into locking engagement with its hammer element 46. The screw element 90 has an external screw thread (omitted for clarity) along substantially the full length of the screw element. The screw element 90 has a hexagonal formation 91 (FIG. 5) at one end to receive a hexagonal turning tool (not shown), such as T-shaped hexagonal manual tool, or a power tool, such as drill, having a hexagonal bit. The screw element 90 is located in the central bore 88 such that the tool drives the screw element 90 from the thin end 82 of the wedge-shaped body.

Figure 5:
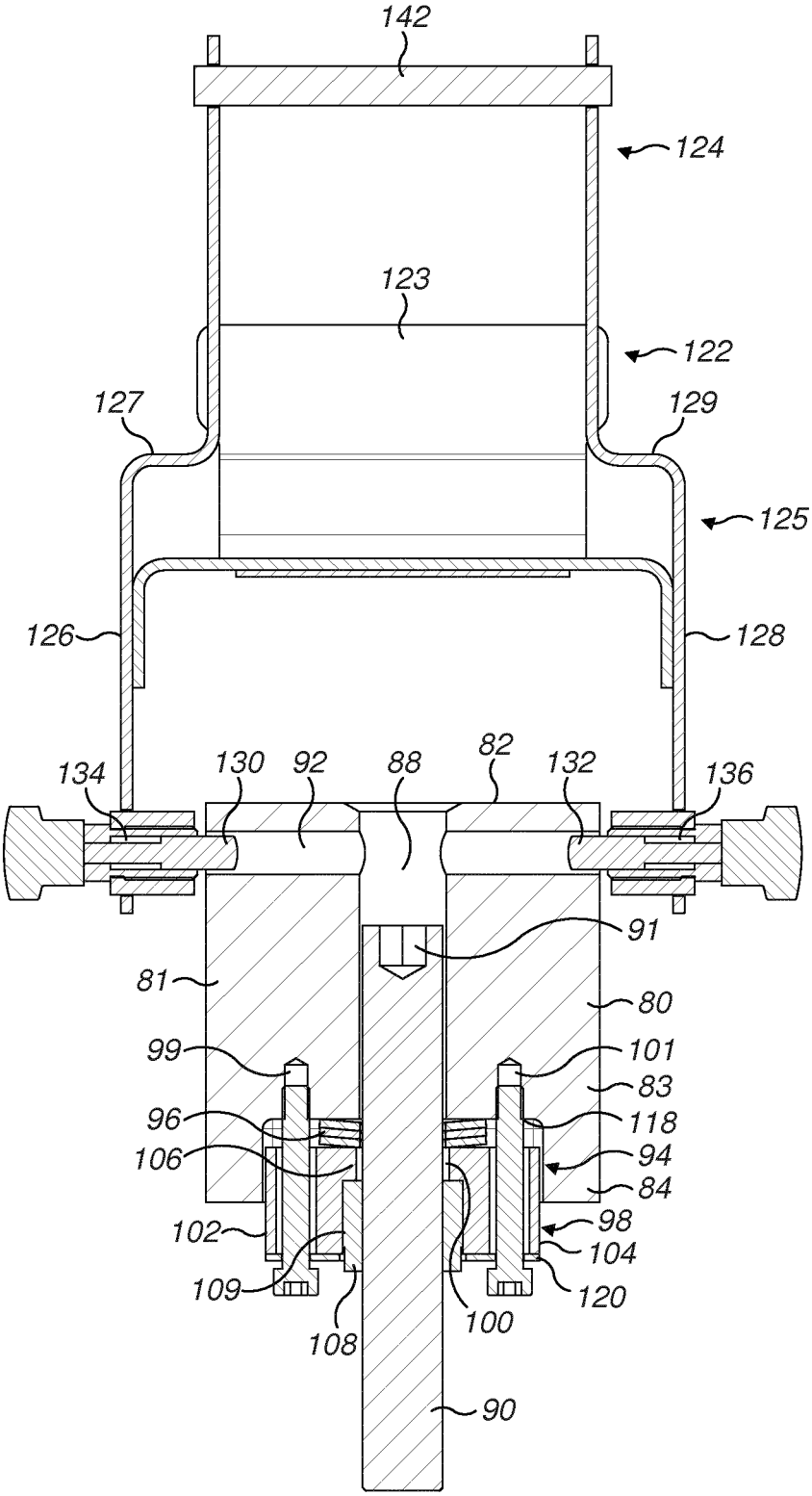
FIG. 5 is a cross-sectional view of the locking device of FIG. 2.
Figure 7:
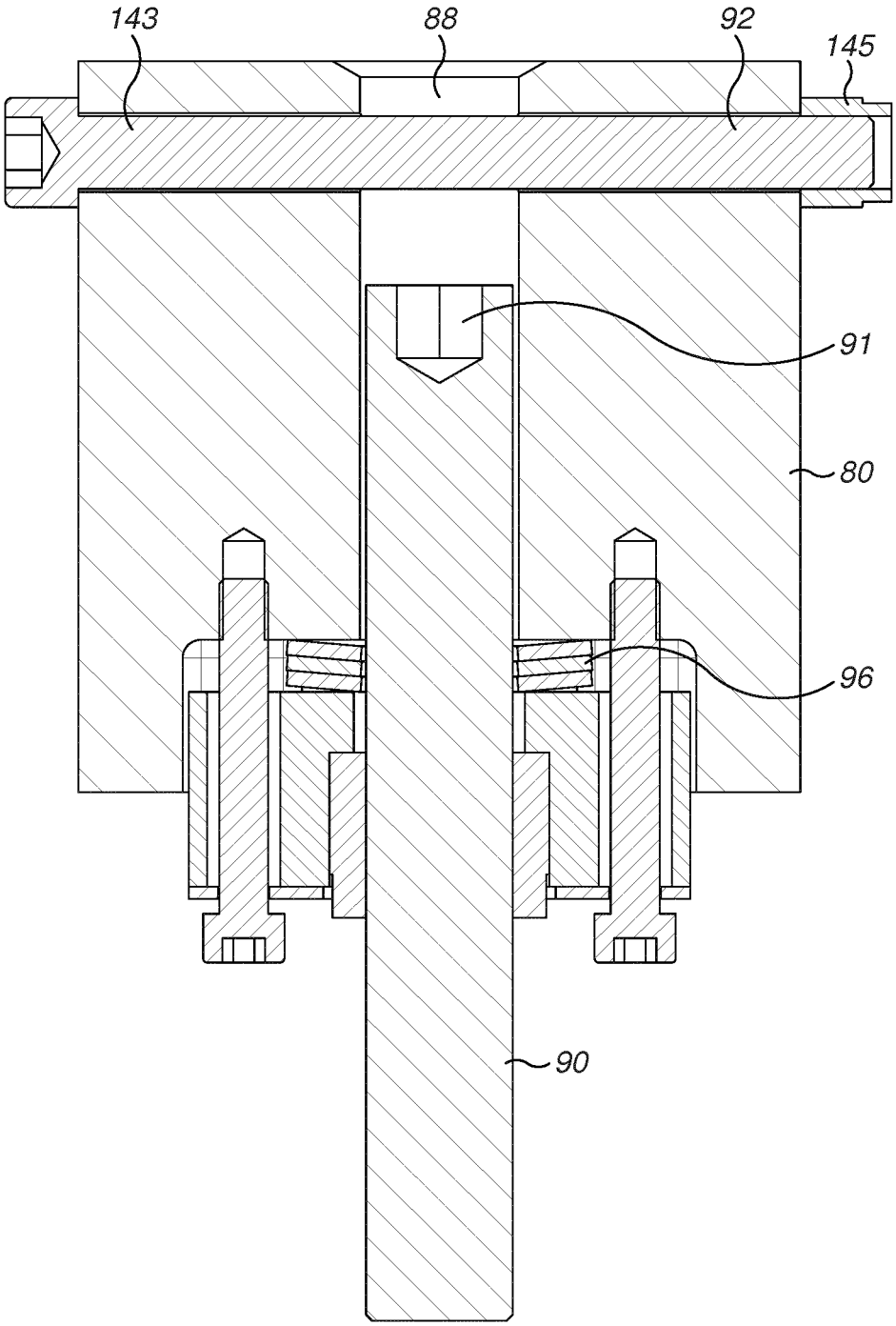
FIG. 7 is a cross-sectional view of the locking device of FIG. 2, with the installation handle removed and a protection bolt provided to protect a locking screw element.

A transverse bore 92 is located at the thin end 82 (see FIGS. 5 and 7). The transverse bore 92 extends through the body 80 from a first side 81 to a second side 83, at the thin end 82 of the body. The transverse bore 92 is arranged substantially perpendicular to the central bore 88. The transverse bore 92 bisects the central bore 88.

The wedge-shaped body 80 includes a recess 94 located at the thick end 84. The recess 94 is arranged to receive three spring or compression washers 96 and house part of a clamping member 98.

Figure 6:
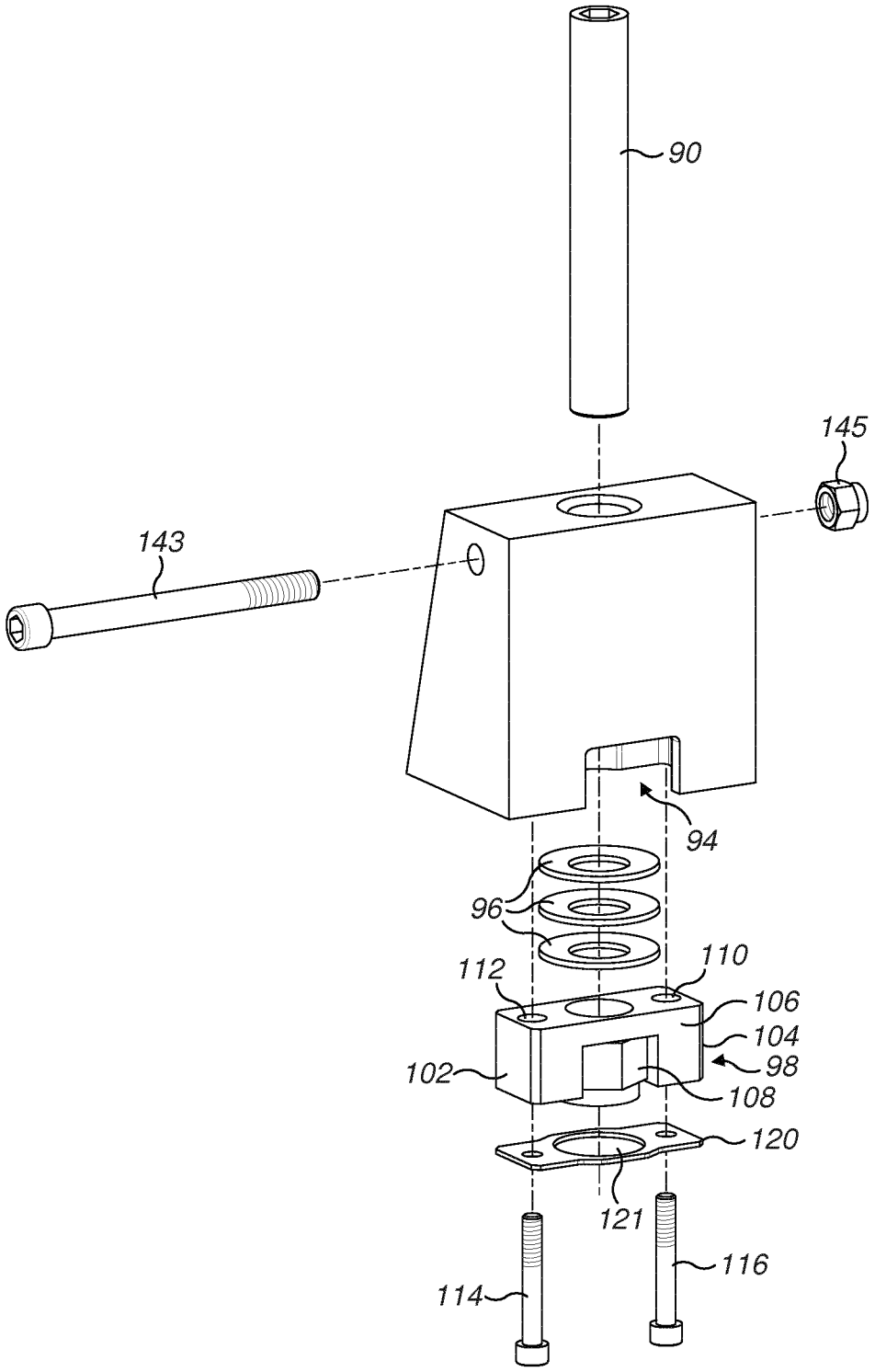
FIG. 6 is an exploded view of the locking device of FIG. 2, with the installation handle removed and a protection bolt provided to protect a locking screw element.

As best seen in FIGS. 6 and 7, the clamping member 98 includes an n-shaped body, having first and second side members 102,104, a cross piece 106 having a hole 100 formed therethrough, and a gap 109 between the first and second side members 102,104. A locking nut 108 is housed in the gap 109 between the first and second side members 102,104. The nut is aligned with the central bore 88 and is arranged to receive the screw element 90. The nut 108 includes an internal screw thread (omitted for clarity) that is complementary to the external screw thread of the screw element 90. The first and second side members 102,104 impinge on the nut 108 and prevent it from rotating, as the screw element 90 travels through the nut 108.

The clamping member 98 includes first and second through bores 110,112, which are arranged to receive bolts 114,116. The clamping member 98 is loosely bolted to the wedge-shaped body 80 by the bolts 114,116, with the three spring or compression washers 96 located between the underside 118 of the wedge-shaped body and the cross-piece 106 of the clamping member. That is, the clamping member 98 is moveable by a limited amount with respect to the bolts 114,116 and the body 80. The bolts 114,116 are screwed into tapped holes 99,101 formed in the body 80. The spring or compression washers 96 and cross-piece 106 of the clamping member sit within the recess 94 formed in the thick end 84 of the wedge-shaped body. A retaining plate 120 is provided at a lower end of the clamping member 98. The retaining plate 120 is attached to the clamping member 98 by the bolts 114,116. The retaining plate 120 prevents the nut 108 from falling out of the clamping member 98. The retaining plate 121 includes a bore 121, which enables the screw element 90 to pass through.

The locking device 60 includes an installation handle 122, which is used to install the wedge-shaped body 80 on to the rotor 4. Three locking devices 60 are used to fix each hammer element 46 to the rotor 4. The installation handle 122 includes two forked arms 126,128, two locking pins 130,132, two springs 134,136 for biasing their respite locking pins 130,132 into locking engagement with the wedge-shaped body 80, and front and rear cross-pieces 121,123.

Each forked arm 126,128 comprises a strip of steel, which has been shaped to include a step 127,129. The forked arms 126,128 are arranged opposite to one another to provide a narrow part 124 and a wide part 125. The narrow part 124 is used as a handle grip for a user of the handle. The wide part 125 of the handle attaches to the wedge-shaped body 80, at end portions.

Figure 8:
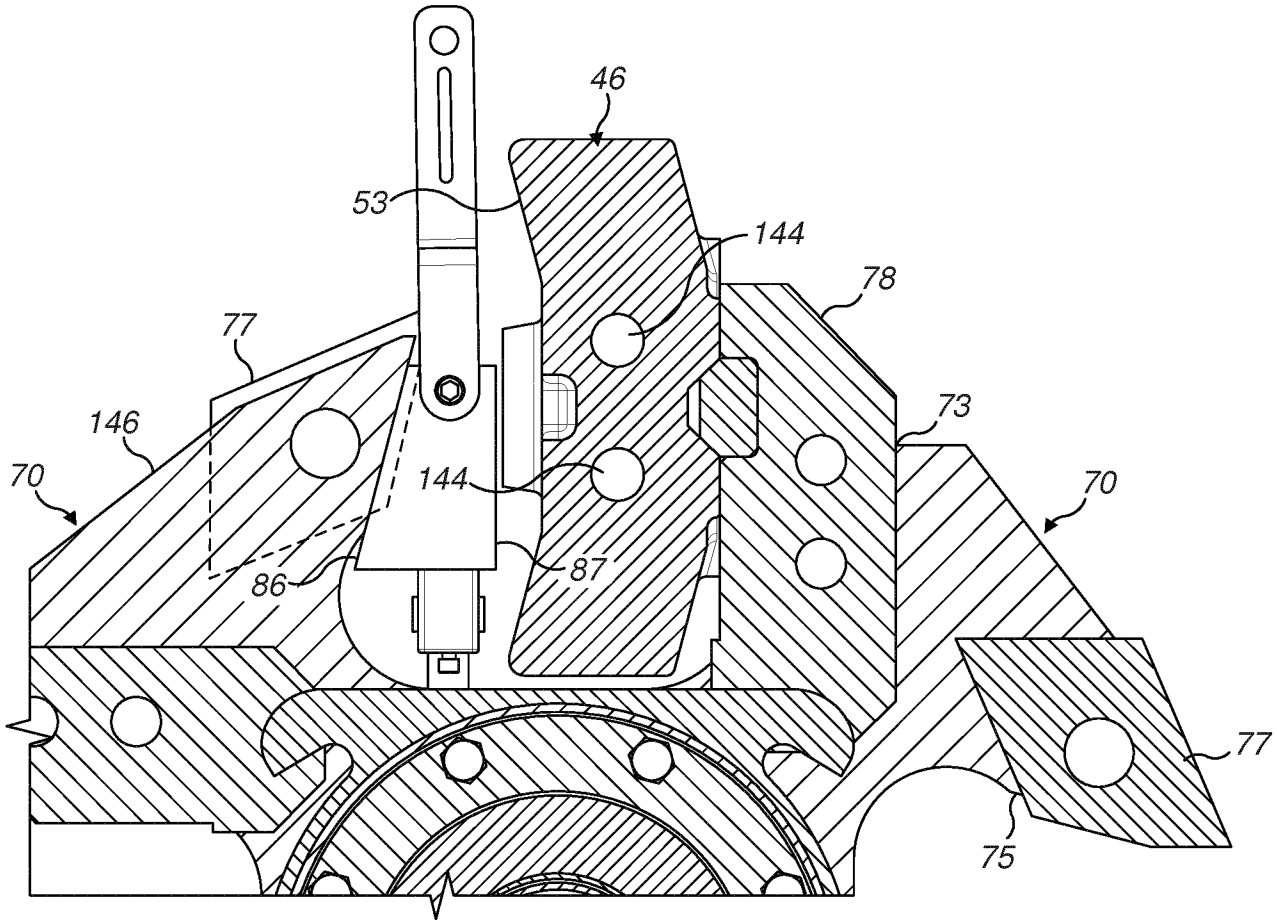
FIG. 8 is an enlarged side view of the rotor of FIG. 2, including the hammer element mounted on to the rotor discs, with the locking device in a non-locked condition.

Locking pin 130,132—spring 134,136 pairs are located towards the end portions of each forked arm 126,128. The installation handle 122 is releasably attachable to the wedge-shaped body 80 by inserting the locking pins 130,132 into the transverse bore 92. The springs 134,136 bias their respective locking pins into locking engagement with the transverse bore 92. The locking pins are movable by a limited amount with respect to their respective forked arms 126,128, which enables the locking pins 130,132 to be retracted from the transverse bore 92. When the handle 122 is attached to the wedge-shaped body 80, the wedge-shaped body 80 is located between the forked arms 126,128. The installation handle 122 is pivotable with respect to the wedge-shaped body 80, about an axis extending through the transverse bore 92. The installation handle 122 is pivotable at the thin end 82 of the wedge. The installation handle 122 is pivotable towards and away from the first and second engagement surfaces 86,87 (FIG. 8). The installation handle 122 is pivotable within the plane of the body 8, which includes the first and second engagement surfaces 86,87.

The front and rear cross-pieces 121,123 provide strength and rigidity to the handle 122. During an installation process, the rear cross-piece 123 is arranged to engage with the first rotor arm 70. This enables the handle 122 to be used as a lever to lift the wedge-shaped body 80 into an initial locking engagement with the hammer element 46. To facilitate this levering function, the rear cross-piece 123 is profiled. It includes a portion 138 that is inclined out of the plane of the forked arms 126,128, and has a rounded engagement edge 140, for engaging at least one of the rotor arm 70 and the plates 77 (see FIGS. 2 and 3).

The front cross-piece 121, comprises a plate which extends across from one forked arm 126 to the other forked arm 128. A further cross-piece 142 is provided in the hand grip portion 124. The further cross-piece is for providing strength and rigidity.

When the handle 122 is not attached to the body 80, a protective bolt 143 can be located in the transverse bore 92 (see FIGS. 6 and 7). The bolt 143 is used to protect the hexagonal formation 91 by preventing crushed rocks from entering into the formation 91. The problem being that if rocks lodge in the hexagonal formation, it can prevent the turning tool from being inserted into the formation 91, which can prevent the locking device 60 from being removed from the rotor 4.

Preferably the body 80 and clamping member 98 are made from steel, however other materials such as cast iron can be used. Preferably the handle 122, bolts 114,116,143 and locking screw 90 are made from steel.

Figure 9:
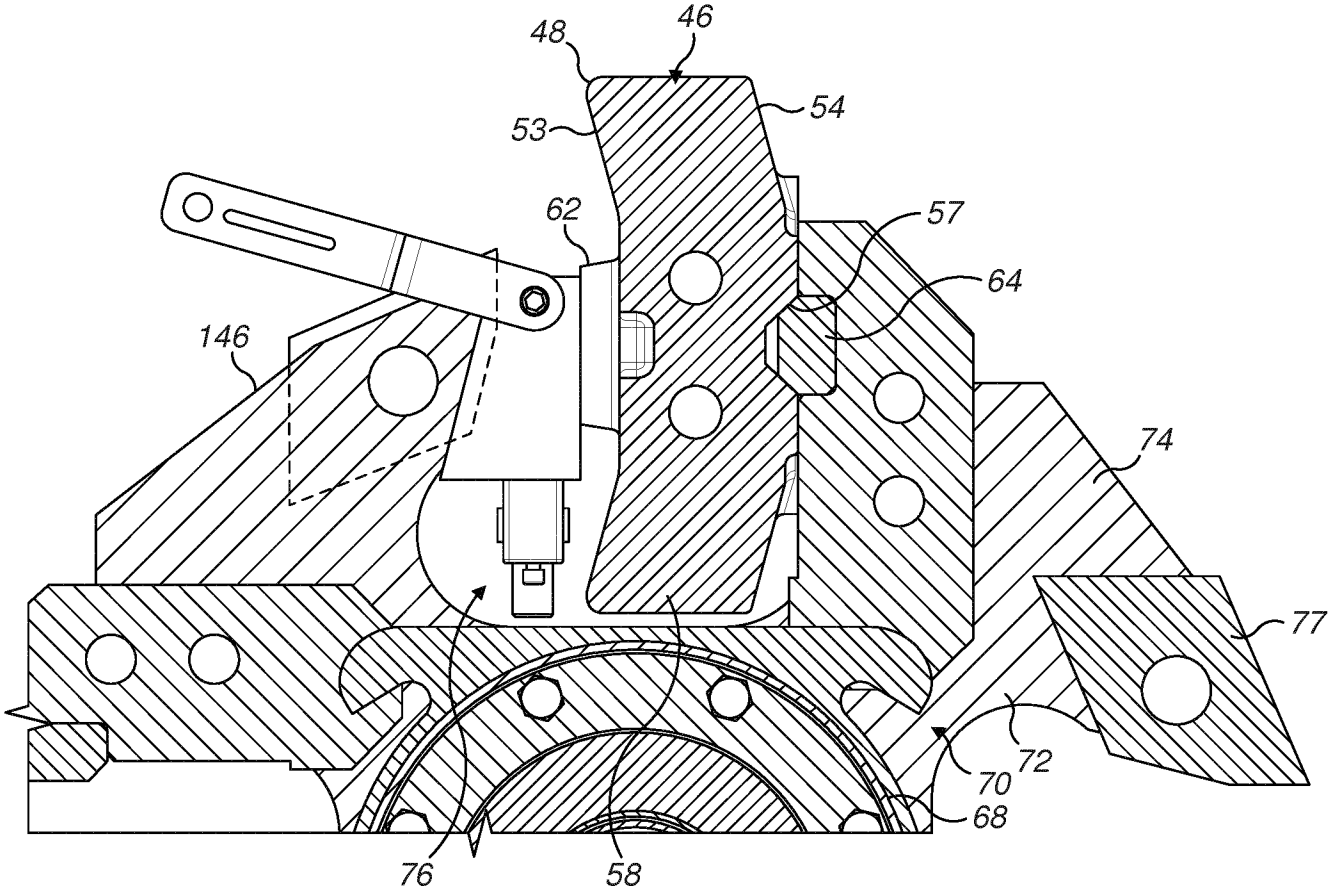
FIG. 9 is an enlarged side view of the rotor of FIG. 2, including the hammer element mounted on to the rotor discs, with the locking device in a partially locked condition.

A process for locking, and unlocking, a hammer element 46 to the rotor 4 will now be described with reference to FIGS. 8 and 9.

A hammer element 46 is supported by a frame (not shown) suspended from a crane (not shown). The frame is bolted to the hammer element 46, the bolts being inserted into holes 144 formed in each end of the hammer element 46. The hammer element 46 is moved into one of the slots 76, and is positioned such that its rear face 54 engages the mounting member 78, and mounting elements 64 are located in slots 57. The hammer element 46 is suspended in this position by the frame and crane.

A fitter mounts a locking device 60 on to the rotor 4. The locking device 60 is located in the slot 76 adjacent the front face 53 of the hammer element, such that the first engagement surface 86 faces towards the trailing face 75, and the second engagement surface 87 faces towards the front face 53 of the hammer element. The thin end 82 of the wedge-shaped body faces radially outwards. The thick end 84 of the wedge-shaped body faces radially inwards. The axial position of the wedge-shaped body 80 is aligned with a rotor arm 70. The wedge-shaped body is located between plates 77.

The locking screw element 90 protrudes out of the body 80, through the spring or compression washers 96 and locking nut 108, and engages an outer surface of the rotor hub 68.

The installation handle 122 is attached to the body 80, by inserting locking pins 130,132 into the transverse bore 92. The fitter pivots the handle 122 relative to the body to engage at least one of an outer surface 146 of the rotor arm 70 and the plates 77. The rear cross-piece 123 engages at least one of the outer surface 146 of the rotor arm and the plates 77. The fitter pushes downwards on the handle grip portion 124, thereby using the handle 122 as a lever. This causes the first engagement surface 86 to slide over the trailing face 75 and moves the wedge-shaped body 80 radially outwards and into engagement with the projection 62. This provides an initial locking engagement by jamming the wedge-shaped body 80 between the rotor arm 70 and the hammer element 46. It will be appreciated that the initial locking effect can be easily and quickly achieved by a single fitter.

The fitter then uses a T-shaped turning tool (not shown), or a power tool, having a hexagonal bit, and drives the screw element 90 through the central bore 88 and locking nut 108 until it tightly engages the outer surface of the hub 68, and further drives the wedge 80 radially outwards and increases the locking load on the hammer element 46. Loading the hammer element 46 in this manner provides a locking arrangement that can hold the hammer element in place while the crusher is operational. It will be appreciated that since the first and second sides 102,104 impinge on the nut 108, the nut does not rotate when the screw element 90 is driven through the nut, this obviates the need for a second fitter to be present to hold the nut 108 with a spanner during this process. Also, the effect of driving the screw element 90 through the nut 108 causes the nut to move along the screw element 90 thereby forcing the clamping member 98 to load the spring or compression washers 96. This helps to provide a tight locking arrangement that does not work itself free during operation of the crusher.

When the wedge-shaped body 80 is locked in place, the handle 122 is removed by unlocking the locking pins from transverse bore 92, and the protective bolt 143 is inserted into the transverse bore 92. The bolt 143 is held in place by a nut 145.

To fully lock the hammer element 46 to the rotor 4 along its length, the above process is repeated to mount at least one further locking device 60 on the rotor at a different axial position. Typically a locking device 60 is located at each rotor disc 66, which is three in the embodiment described.

The frame is then unbolted from the hammer element, the hammer element being fully locked to the rotor 4.

The process can be repeated for mounting one or more additional hammer elements 46 to the rotor 4, typically by rotating the rotor 4 so that a new slot 76 is facing upwardly.

To remove a hammer element 46 from the rotor 4, the frame is reattached to the hammer element, and is supported by the crane.

For each locking device associated with the hammer element 46, the fitter loosens off the screw element 90 and hits the wedge-shaped body 80 with a percussive tool, such as a hammer. This causes the wedge 80 to break its locking engagement between the hammer element 46 and the rotor arm 70.

The hammer element 46 can be lifted clear from the rotor 4 by the frame and crane. The hammer element 46 can be refitted to the rotor 4 in a new orientation, or a new hammer element can be mounted into the slot 76.

It will be apparent to the skilled person that modifications can be made to the above embodiments that fall within the scope of the invention, for example the handle may have a different means of attaching itself to the wedge-shaped body 80. For example, instead of having locking pins for engaging the transverse bore 92, the handle may include formations that are arranged to engage bolt 143. The handle being pivotable about the bolt 143, or if the handle is tightly fitted to the bolt 143 in a releasable manner, the bolt 143 can be loose in the transverse bore 92 and the bolt-handle unit 143-122 can pivot with respect to the body 80. In this arrangement, it would not be necessary to remove bolt 143 from the body 80.

The rotor 4 may include a different number of rotor discs 66.

The crusher may include a different number of locking devices 60 per hammer element 46.

It will be appreciated that not every locking device 60 in a set of locking devices requires an installation handle 122. In some embodiments only one handle 122, or a relatively small number of handles 122, may be required for several wedge-shaped bodies 80. The number of handles 122 provided, to some extent is determined by the number of fitters an owner wants working simultaneously when installing hammer elements.

The invention claimed is:

1. A locking device configured to fix a hammer element to a crusher rotor of a horizontal shaft impact crusher, the locking device comprising:

a locking-wedge including a first bore;

a screw element for driving the locking-wedge into a locking position between an associated rotor arm and hammer element, and for holding the locking-wedge in the locking position;

a locking nut arranged to receive the locking screw element; and a locking nut holder, wherein the first bore is arranged to receive the screw element, the screw element being drivable through the locking nut, and wherein the locking nut holder is arranged to hold the locking nut in a manner that prevents the locking nut from rotating as the screw element is driven through the locking nut.

2. The device according to claim 1, wherein the nut holder is releasably attachable to the locking-wedge by an attachment device, the attachment device being a plurality of bolts.

3. The device according to claim 1, wherein the nut holder is arranged for limited movement with respect to the locking-wedge, the arrangement being such that driving the screw element through the nut causes the nut holder to move towards the locking-wedge.

4. The device according to claim 2, further comprising resilient means, such as at least one spring or compression washer, located between the locking-wedge and the nut holder, wherein the nut holder is arranged to clamp the resilient means between the nut holder and the locking-wedge as the screw element is driven through the nut.

5. The device according to claim 1, wherein the nut holder includes a clamping member having first and second side members and a cross-piece, wherein the nut is housed in a gap between the first and second side members, and the clamping member impinges on the nut thereby preventing the nut from rotating when the screw element is driven through the nut.

6. The device according to claim 5, further comprising a retaining member for retaining the nut in place, wherein the retaining member is releasably attachable to the clamping member.

7. The device according to claim 1, wherein the locking-wedge includes a thin end and a thick end, the first bore extending through the locking-wedge from the thin end to the thick end.

8. The device according to claim 7, wherein the locking-wedge has a right trapezoid cross-section.

9. The device according to claim 7, wherein the locking-wedge includes a recess formed at the thick end, the recess being arranged to house the resilient means.

10. The device according to claim 1, further comprising a second bore bisecting the first bore.

11. The device according to claim 10, wherein the second bore is arranged perpendicular to the first bore.

12. The device according to claim 10, further comprising a protective member, such as a bolt, removably insertable into the second bore.

13. The device according to claim 1, further comprising an installation handle releasably attachable to the locking-wedge and being arranged to lever the locking-wedge into an initial locking position.

14. A horizontal shaft impact crusher comprising:

a crusher rotor;

at least one hammer element;

at least one rotor disc having a plurality of rotor arms; and at least one locking device the at least one locking device including a locking-wedge in a locking position between a rotor arm and the hammer element, said locking-wedge fixing the hammer element to the rotor disc, a screw element arranged to drive the locking-wedge into the locking position, and for holding the locking-wedge in the locking position, a locking nut arranged to receive the locking screw element, and a locking nut holder, wherein the locking-wedge includes a first bore, the screw element being at least partly located in the first bore and extending through the locking nut and wherein the locking nut holder holds the locking nut in a manner that prevents the locking nut from rotating as the screw element is driven through the locking nut.

15. A crusher according to claim 14, wherein the rotor includes a second rotor disc having a plurality of rotor arms and a second locking device arranged to lock the hammer element to the second rotor disc.

* * * * *